United States Patent [19]

Goldfarb et al.

[11] 4,114,877

[45] Sep. 19, 1978

[54] MEMORY SKILL GAME

[76] Inventors: Adolph E. Goldfarb, 4614 Monarca Dr., Tarzana, Calif. 91356; Erwin Benkoe, 17965 Medley Dr., Encino, Calif. 91316

[21] Appl. No.: 764,203

[22] Filed: Jan. 31, 1977

[51] Int. Cl.[2] ..... A63F 9/00

[52] U.S. Cl. ..... 273/1 R; 273/157 R

[58] Field of Search ..... 273/1 R, 1 E, 1 M, 157 R, 273/132; 35/22 R, 22 A

[56] References Cited

U.S. PATENT DOCUMENTS

| | | | |
|---|---|---|---|
| 143,835 | 10/1873 | Muller | 273/157 R |
| 260,594 | 7/1882 | Mehner | 273/157 R |
| 1,439,359 | 12/1922 | Estes | 273/157 R |
| 1,492,671 | 5/1924 | Bruel | 273/157 R X |
| 2,202,592 | 5/1940 | Maxson | 273/157 R UX |
| 3,471,148 | 10/1969 | Janiszewski et al. | 273/1 R |
| 3,471,149 | 10/1969 | Glass et al. | 273/1 R |
| 3,612,527 | 10/1971 | Rogerson | 273/1 R X |
| 3,961,794 | 6/1976 | Goldfarb et al. | 273/132 |

FOREIGN PATENT DOCUMENTS

| | | | |
|---|---|---|---|
| 911,228 | 5/1954 | Fed. Rep. of Germany | 273/157 R |
| 633,951 | 12/1949 | United Kingdom | 273/157 R |

*Primary Examiner*—Paul E. Shapiro

*Attorney, Agent, or Firm*—Robert M. Ashen; Robert J. Schaap

[57] ABSTRACT

A time controlled memory-skill game comprised of a tower capable of generally continuous rotating by means of a simple wind-up spring motor and displaying one or more designs to be recreated through playing pieces by one or more players. Substrates each having a design imprinted thereon can be removably retained on an exterior surface of the rotating tower such that it would rotate and intermittently present the designs to one or more players seated around the rotating tower. Each player may have a different design to recreate or one or more designs can be shared by players. Each of the players is provided with a playing board and a plurality of playing pieces with design portions thereon such that each player can recreate his design as shown on the tower by locating playing pieces in the proper locations and orientations. A switch may be connected to the tower for stopping its rotation when one of the players has recreated his design, or the tower may stop after a predetermined time interval. In a preferred aspect of the present invention the playing pieces are three-dimensional, in the form of cubes.

31 Claims, 9 Drawing Figures

MEMORY SKILL GAME

BACKGROUND OF THE INVENTION

This invention relates in general to memory-skill games and more particularly, to memory-skill games in which a player can recreate a design on a rotating member by means of playing pieces in a time constrained manner.

In recent years, there have been introduced several forms of memory-skill games. Some of these games have been based on the principle that a player is required to recreate or determine a particular design based on an observation of a portion of the design. For example, several forms of concentration-type games presented on television media require the participants to determine what device or item is being depicted upon seeing a portion of the device or the item forming the design.

Another form of memory-skill game designed for home use involves a rotating tower having a set of non-related pictorial images retained on one flat side of the tower. The players are each provided with two-dimensional playing cards which include cards matching the images on the tower. The players race each other to select from their cards the ones having the images on the tower, and to arrange the selected cards to reproduce the arrangement of images on the tower. In this way, the player is required to remember the design or a portion thereof in order to assemble a portion of the design with the playing cards with little or no delay during the period in which the design is rotated so that it is out of the view of the player. Continued rotation of the tower renders the design viewable to the player again so that further reconstruction of the design may be enabled.

The playing pieces in this last-mentioned type of memory-skilled game were also only orientable in one direction in order to complete the design, much in the same manner as pieces of a puzzle are assembled to create the design. Thus, little manipulative skill was require, since it was not necessary to orient the playing pieces as between several possible orientations in order to create the overall design. Further, the play value of this form of memory-skill game was limited: There is only one design on the rotating tower at any point in time, and each player was provided with only two-dimensional playing cards, each having the same design faces. Thus, all the players had to have at least the same general degree of skill in order to make the play of the game competitive.

OBJECTS OF THE INVENTION

It is, therefore, a primary object of the present invention to provide a memory-skill playing game where one or more players are required to create a design with playing pieces orientable in multiple directions in order to match or reconstruct an intermittently viewable design.

It is another object of the present invention to provide a memory-skill game of the type stated in which a plurality of designs can be reconstructed in any one game by a plurality of players, thereby enabling a plurality of players of differing skills to play the game on a competitive basis.

It is a further object of the present invention to provide a memory-skill game of the type stated in which a plurality of designs can be exposed to any one player during the course of the game, thereby requiring the player to discriminate between these designs in order to reconstruct a specific design, thereby increasing the amount of skill required in the game.

It is also an object of the present invention to provide a game of the type stated which can be used in a variety of modes of play, thereby increasing the utility of the game.

It is a salient object of the present invention to provide a method of playing a memory-skill game in which a player must orient three-dimensional playing in proper directions and combine a plurality of such playing pieces in order to match or reconstruct an intermittently viewable design.

With the above and other objects in view, our invention resides in the novel feature of form, construction, arrangement and combination of parts presently described and pointed out in the claims.

BRIEF SUMMARY OF THE DISCLOSURE

The present invention relates to a memory-skill playing game. There is disclosed a rotatable tower having a plurality of retaining frames located on various exterior walls of the tower and which are designed to removably receive design cards bearing a design on the surface thereof. The tower is somewhat rectangular in shape presenting four flat walls with retaining frames so that design cards can be located within each of the four retaining frames. The tower is rotatably mounted on a base member which is powered by a suitable motor in the base member, such as for example, a spring wind-up motor. A winding mechanism is also associated with the tower for winding the motor in order to rotate the tower. In addition, a stop mechanism, in the form of a push-button switch, is provided on the tower so that any one of the players who first completes the game can stop the motor by acutation of the push-button switch on the tower.

Each of the players are provided with trays or similar devices in which to reconstruct the design on the tower by means of playing pieces. In one embodiment of the present invention, the playing pieces may be triangular in shape, as for example, a triangularly shaped two-dimensional playing card which has a single color on one surface thereof. In another embodiment of the present invention, rectangular two-dimensional playing cards may be used. These latter playing pieces are preferably divided into two triangular sections, one of which is preferably of a first color and the other of which is preferably of a second color. In one aspect of the invention, for example, one of the triangular sections may be, e.g. red, whereas the other of the triangular sections may be, e.g., white.

In the preferred embodiment of the present invention, the playing pieces are three-dimensional, as for example, in the form of cubes or playing blocks. In this case, one or more flat surfaces of the playing blocks may have a first color, such as a red color, and other flat surfaces of the playing blocks may have a second color, such as a white color. Still other flat surfaces of the blocks will be divided into two triangular sections, one of which has the first color and the other of which has the second color. It should be understood in this regard that various color modes and various designs could be used in connection with the playing pieces of the present invention.

The game of the present invention may be played in various modes, some of which are briefly described below in order to show the wide versatility of the game of the present invention. In one mode of play, each of a plurality of players may be provided with the same design card, such that the same design card is located in each of the retaining frames on the rotating tower. Each of the players will thereupon resconstruct the design by means of the playing pieces in the smallest possible time period and the player who first reconstructs the design with his playing pieces wins the game.

In another mode of play, only one design card may be located in one retaining frame so that it revolves among the various players who are seated around the tower. Thus, each player must carefully observe the design on the tower as it rotates by and attempt to reconstruct the design with his playing pieces from memory, until the design again rotates past the player.

In another mode of play, each of the players may be provided with individual design cards where the designs on such design cards differ. Again, each player must attempt to reconstruct his design from the design on his or her selected design card. In this way, players with lesser skills, as for example, younger players may compete with players of greater skills such that the players of greater skills will have a harder design and thus provide a handicap within the game.

In yet a further mode of play, an individual player may attempt to reconstruct a design by the use of playing pieces against a predetermined time, that is, against the clock. In this way, the player can attempt to beat previous times in reconstructing a particular design.

One of the unique aspects of the present invention is that more than one design can be located on the tower and this requires each of the individual players to exercise greater skill by looking for their particular design and attempting to remember the design pattern in order to resconstruct the same. Where only one design is located on the tower, the degree of skill required in the play of the game is considerably less.

The playing pieces which are used in the reconstruction of the designs are highly effective in that they require the player to not only select the right playing piece, but to orient this playing piece in the proper direction with respect to at least one or more adjacent playing pieces. Thus, the game of the present invention requires more skill and concentration than merely putting together pieces to reconstruct a design, much in the same manner as putting together a puzzle.

Another one of the unique aspects of the invention is that each of the players essentially see their selected design card essentially simultaneously. In the prior art devices, one of the players had an advantage in that this player would see the design card before someone else if all of the players were seated around a table. In the case of the present invention, each party's design card can be placed out of view and the first time that the player will see his design card is when the tower is rotated so that the design for each player is simultaneously brought into the view of each of the players.

BRIEF DESCRIPTION OF THE DRAWINGS

Figure 1:
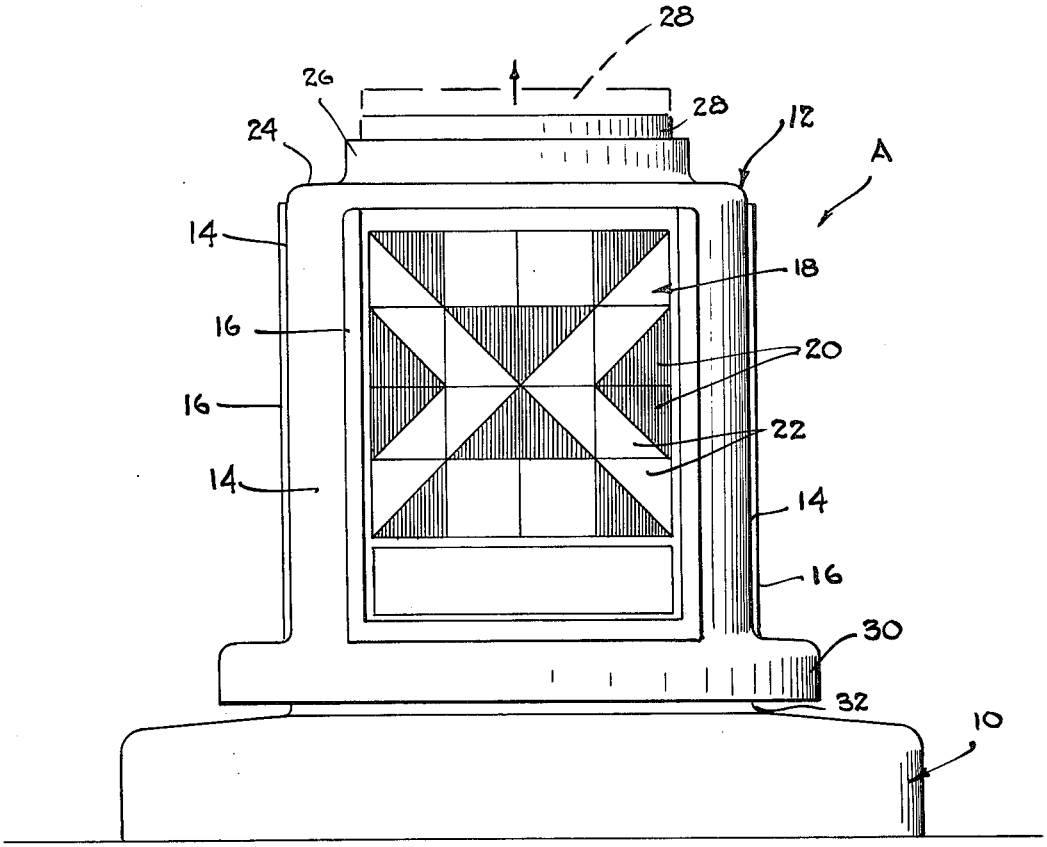
Figure 2:
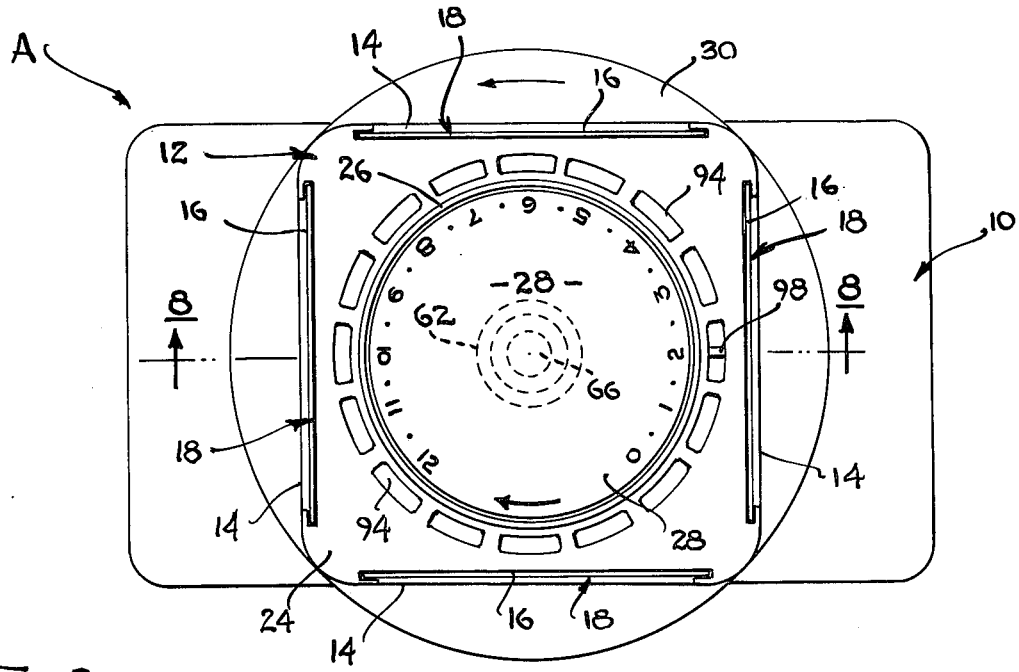
Figure 3A:
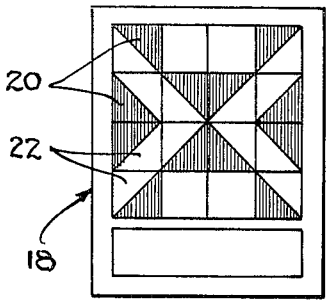
Figure 3B:
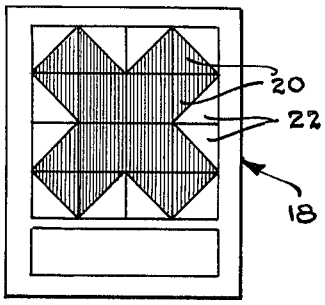
Figure 4:
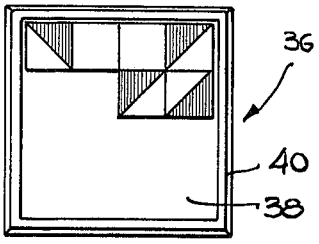
Figure 5:
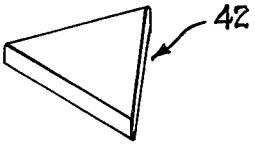
Figure 6:
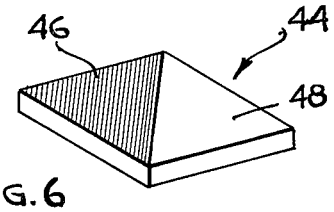
Figure 7:
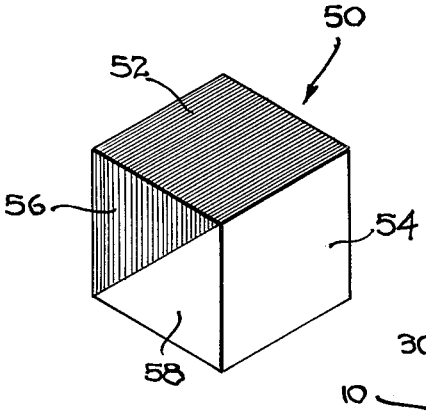
Figure 8:
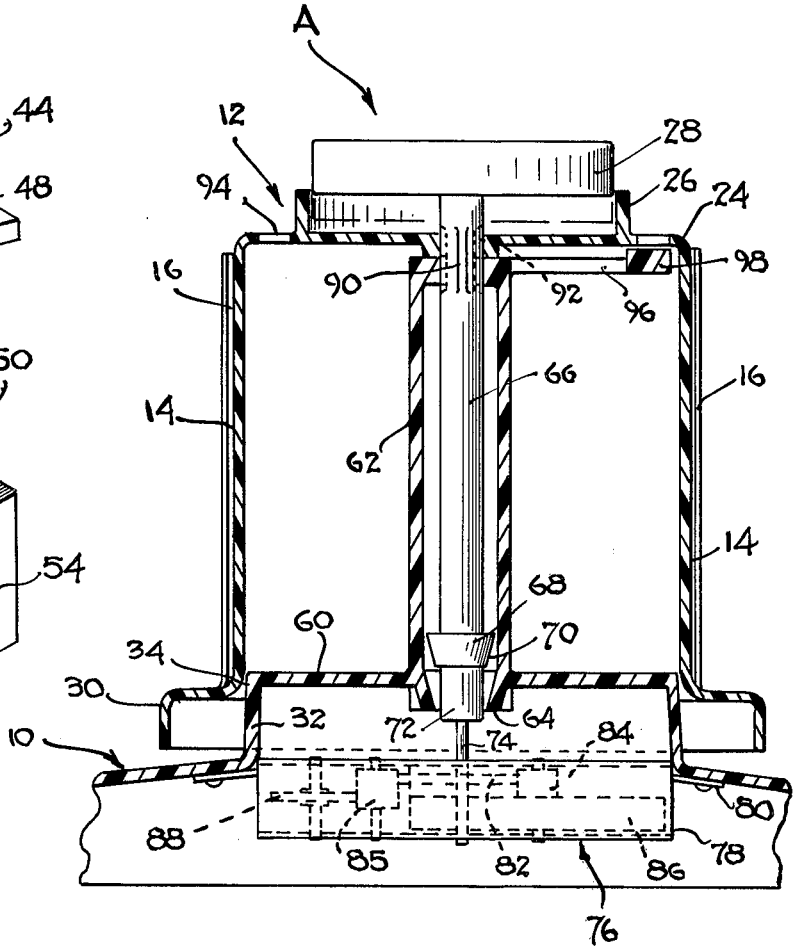

Having thus described the invention in general terms, reference will now be made to the accompanying drawings in which:

FIG. 1 is a front elevational view of a rotating tower device used in the playing game of the present invention;

FIG. 2 is a top plan view of the device of FIG. 1;

FIG. 3A is a top plan view showing one form of design card which may be removably located in the tower of FIG. 1;

FIG. 3B is a top plan view of another design card showing a different design and which may be removably located in the tower of FIG. 1;

FIG. 4 is a top plan view of playing pieces in a retaining tray in which playing pieces have been assembled to reconstruct a portion of the design (of FIG. 3A) in the rotating tower device of FIG. 1;

FIG. 5 is a perspective view of a first form of playing piece which may be used in the present invention;

FIG. 6 is a perspective view of a modified form of playing piece which may also be used in the game of the present invention;

FIG. 7 is a perspective view of still a further modified form of playing piece which may be used in the game of the present invention; and FIG. 8 is a vertical sectional view, taken along line 8—8 of FIG. 2.

DETAILED DESCRIPTION

Referring now in more detail and by reference characters to the drawings, A designates a rotating tower device comprising a base housing 10 and an upstanding rotatable tower 12. The tower 12 is generally rectangular in shape, as illustrated in FIG. 2, and is provided with four exterior flat walls 14 in a rectangular configuration. Suitably mounted on the flat walls 14 are rectangularly shaped card receiving frames 16 which are opened at their upper ends in order to receive design cards 18. In the preferred embodiment of the invention, the tower 12 may be molded as a simple unit from a plastic material in which case the frames 16 will be integral with the tower 12 and recessed therein as shown in FIG. 2.

By reference to FIG. 1 it can be observed that one such design card 18 is located in one of the frames 16 and is provided with a design of its exterior face. In accordance with this construction, one or more design cards can be introduced into the retaining frames 16 in order to enable play in the various modes of play as previously described. For convenience, the design cards may be made of a paperboard material with the designs suitably imprinted on one flat surface thereof.

As indicated previously, the design on the design card 18 is primarily composed of colored triangles, as for example, those colored triangles shown as being colored for red in FIG. 1, and designated by reference numeral 20, and those triangular portions shown as being colored for white and designated by reference numeral 22. However, any form of design pattern could be used in the present invention. One of the unique aspects of this form of design is that the playing pieces (hereinafter described) have proper design segment shapes and are color coded with respect to the design cards 18 so as to enable a recreation of the design on the design card 18.

FIG. 3A illustrates one form of design pattern, as also shown in the tower of FIG. 1, which can be created using the triangular playing pieces or the other playing pieces having triangular sections thereon. FIG. 3B illustrates a design card with another form of design pattern which can be created by using the playing pieces which are triangular in shape or which have triangular sections thereon. Thus, these triangular sections may be constituted of individual elements or they may be subdivided and colored with different colors on a rectangular flat playing piece or three dimensional playing piece.

The tower 12 is constructed in the form of a bell-shaped housing and is provided with a top wall 24 integrally connected to the flat walls 16 and which integrally merges into an upwardly projected circularly shaped retaining flange 26. Projecting upwardly from the retaining flange 26 is a winding knob 28 which is connected to a motive means in a manner to be hereinafter described in more detail. This winding knob 28 is designed to wind a spring operated motor (also described hereinafter) and also to start and stop the rotating movement of the tower 12. As indicated in FIG. 1, it can be observed that the winding knob 28 is illustrated in its lower-most position (in solid lines) where the winding knob is designed to stop the rotation of the tower 12. The upper-most position of the winding knob 28 illustrated in fantom lines in which case the winding knob 28 permits rotation of the tower 12.

The lower end of the bell-shaped housing which forms the tower 12 is provided with an outwardly flaring and downwardly struck skirt section 30 which permits rotatable mounting of the tower 12 on an upwardly struck cylindrically shaped hub 32 formed on the base section 10, in the manner as more fully illustrated in FIGS. 1 and 8 of the drawings. In this case, it can be observed that the upper edge of the hub 32 (designated by reference numeral 34) serves as a bearing surface for supporting the tower 12 in its rotatable movement.

FIG. 4 illustrates a tray 36 which may be used by the players who are playing the game of the present invention. In this case, an individual tray 36 would be provided for each player and in the embodiment as illustrated, four individual trays 36 would be provided. It can be observed that tray 36 is provided with a relatively flat bottom wall 38 and an upstanding peripherally extending ridge 40, in the manner as illustrated in FIG. 4. Furthermore, as illustrated in FIG. 4, a plurality of playing pieces have been assembled in order to partially create the design illustrated in FIG. 1.

The various components forming part of the device A as well as tray 36, except for the motive means (hereinafter described) in the device A can all be constructed of a number of well-known plastic materials including for example, polyethylene, polystyrene, polybutadiene, a number of known vinyladiene copolymers and the like. These components may be formed in any of a number of known plastic forming techniques including blow molding, injection molding, thermo-forming and the like. However, it can also be observed that many of the components forming part of the device A as well as the tray 36, for that matter, could be formed of other materials including light weight metals, such as aluminum or the like. Moreover, these various components can be formed of reinforced plastic materials as for example, resin matrix reinforced plastics including, e.g., thermosetting and thermoplastic resins along with various fiberous materials such as glass, boron, carbon or the like. The particular materials used in the construction of these components will be predicated upon necessary strength requirements and desired durability as well as manufacturing costs.

FIG. 5 illustrates one form of playing piece 42 which may be used in accordance with the present invention. In this case, the playing piece 42 adopts the form of a card-like member, that is, it is essentially two dimensional in nature and in this case, the playing piece 42 is triangular in shape. In accordance with the preferred design pattern which is constructed of triangular sections, it can be observed that the triangular playing pieces 42 would be provided in plurality for each player, to effectively operate to form the designs illustrated as for example in FIGS. 3A and 3B. In this case, some of the playing pieces 42 may be colored of one of the preferred colors as for example, either red and the other of the playing pieces would be colored white. In the same respect, it can be observed that the designs on the playing pieces could be of multiple colors such that the playing pieces could be provided with more than two colors as for example, red, white, green, etc. In this respect, the players will be provided with playing pieces 42 in such amounts with the desired colors in order to create the required design with the required color scheme.

FIG. 6 illustrates a modified form of playing piece 44 which may also be used in the game of the present invention. In this case, the playing piece 44 is rectangular in shape, although it is subdivided into design portions, e.g. a red section, designated as 46, and a white section, designated as 48. Again, the playing piece 44 is essentially two-dimensional so that the player merely orients the playing piece 44 in order to properly locate the red section 46 and the white section 48 with respect to the remainder of the design being created within the tray 36. In the same respect, it can be observed that the tray 36 can be eliminated such that the player would merely create the design from the playing pieces on a flat surface.

FIG. 7 illustrates one of the most preferred forms of playing pieces 50, which is essentially three-dimensional in nature. In this respect, a three-dimensional playing piece is one which has two faces which are not parallel and which two faces have design portions thereon. The playing piece 50 in the most preferred aspect of the present invention adopts a cubular configuration such as a conventional playing block. However, the playing piece 50 is provided with at least one flat surface 52 which is of the first color, such as red, and at least one other surface 54 which is of the second color, such as white. Finally, at least one or more surfaces of the playing piece 50 is subdivided into a red triangular section 46 and a white triangular section 58, in the manner as illustrated in FIG. 7. Thus, in this form of playing piece 50, two of the surfaces of the cube could be of the pure white color, two other surfaces could be of the pure red color and the remaining two surfaces could be subdivided into the red section 56 and the white section 58.

With respect to the playing pieces 50, it can be appreciated that these playing pieces require a much greater degree of skill and strategy in playing the game of the present invention. In this case, it can be observed that the playing piece 50 can be oriented in several ways in order to create the design of the present invention, particularly with respect to adjacent playing pieces. Thus, for example, the player does not merely pick up a playing piece in the form of a puzzle-like element and merely locate the playing piece in the desired orientation (which is usually a single orientation for purposes of creating the design), but must locate the proper surface which is required and orient this surface with respect to the remaining portion of the design being created through the playing pieces. Thus, a much greater degree of skill can be required when using the three-dimensional playing pieces.

Each of the design cards 18 may be provided with a color coded section such as the horizontal lower stripe as shown and the tray 36 may be similarly color coded to match the color coded section on the design cards. Thus, for four players, four sets of design cards could be provided with each set having a color coded section on each card different from the color coded sections of each of the other set of cards. In like manner, each of the four trays would be colored of the same color as the color coded sections on the associated set of design cards. In this way the players can correlate the color of their tray with the color coded section of their design card and the players can more readily spot their design as it comes around. It should be understood that the color section for the design card could also be on the rotatable member on the retaining frame for the design card in lieu of it being on the design card.

FIGS. 2 and 8 more fully illustrate the internal mechanism included within the tower 12 and the base housing 10 for permitting rotation of the tower 12. In this case, it can be observed that the upstanding hub 32 is provided with a horizontal top wall 60 which integrally merges into upstanding cylindrically shaped sleeve 62. In addition, the horizontal top wall 60 also integrally merges into a downwardly struck conically shaped locking socket 64 for reasons which will more fully appear hereinafter.

The winding knob 28 is both axially and rotatably movable within the retaining flange 26. Moreover, the winding knob 28 is secured to an actuating shaft 66 which is disposed concentrically within the sleeve 62. At its lower end, the actuating shaft 66 is provided with an integrally formed collar 68 having a conically shaped locking section 70 and a cylindrically shaped extension 72. By further reference to FIGS. 1 and 8, it can be observed that when the winding knob 28 is in its uppermost position, as illustrated in the phantom lines of FIG. 1, then the conically shaped section 70 would be located above the socket 64 and the extension 72 would be engageable with the socket causing rotation thereof about a vertical axis. However, when the winding knob 28 is shifted to its lowermost position, as illustrated in the solid lines of FIG. 1, the conically shaped section 70 would serve as a wedge received within the locking socket 64 and thereby prevent rotation of the actuating shaft 66. Thus, by pulling up on the knob 28, it is possible to permit rotation of the shaft 66 as well as the tower 12 and by pushing downwardly on the winding knob 28, it is possible to prevent rotation of the shaft 66 and hence the tower 12. In this way, the players of the game can start the rotation of the tower in a time-constrained game by merely urging the winding knob 28 upwardly and the player who first completes the design can stop the rotation of th tower 12 merely by pushing downwardly on the winding knob 28. It should also be observed that the tower could be constructed to be rotatable about an axis other than a vertical axis, e.g. a horizontal axis. In like manner, the tower could be adaopted for other forms of movement, such that the designs on the tower are intermittently presented.

The extension 72 is provided at its lower end with a drive shaft 74 which is connected to a conventional wind-up spring operated motor 76, the details of which are illustrated in the dotted lines of FIG. 8. In this case, it can be observed that the spring motor 76 is located within the base housing section 10. The spring motor 76 is typically provided in a conventional casing 78 which is provided with outwardly struck flanges 80 for securement to the housing section 10 in the manner as illustrated. In addition, the spring motor 76 is provided with a major pinion gear 82 secured to the drive shaft 74 and which mates with a pinion gear 84 and another pinion gear 85. The gear 84 operates a spring 86 which will be wound upon rotation of the winding knob 28 in one direction.

The spring 86 will provide the necessary power for rotation of the drive shaft 74 and hence the actuating shaft 66 along with the tower 12 in the opposite direction, when released. The pinion gears 85 cooperates with an escapement mechanism 88, in the form of a star-wheel, which enables controlled intermittant but essentially continuous rotatable movement of the tower 12. In essence, and as indicated, the spring motor 76 is essentially conventional in its construction and is therefore neither illustrated nor described in any further detail herein.

It can be observed in accordance with the present invention that the rotation of the tower 12 is initiated and stopped by virtue of the collar 68 co-acting with the locking socket 64. However, other forms of locking mechanisms could be provided. Alternatively, a pinion gear could be mounted on the shaft 88 and cooperate with a ring gear located within the skirt section 30 for rotation of the tower 12 independently of the actuating shaft 66. In any event, in accordance with the construction illustrated, it can be observed that by rotating the winding knob 28 in one direction, it is possible to wind the spring of the spring motor 76 when the knob 28 is in the upward position. Also, when the knob is in the upper position, the spring motor 76 will operate thereby permitting rotation of th actuating shaft 66 and the winding knob 28 along with the tower 12.

The tower 12 is rotated with the shaft 66 by means of splines 90 which cooperates with mating sections 92 in the top wall 24 of the tower 12. In this way, it can be observed that splined sections 90 permit axial shiftable movement of the actuating shaft 66 with respect to the tower 12, but nevertheless, provides rotatable movement of the tower 12 with the actuating shaft 66.

The top wall 24 of the tower 12 is provided with a series of rectangularly shaped closely spaced apertures 94 located in a circular array, in the manner as illustrated in FIGS. 2 and 8 of the drawings. Also extending outwardly from the sleeve 62 is an arm 96 carrying a marker or so-called "starter tab" 98 which appears through one of the apertures 94, in the manner as illustrated in FIG. 2 of the drawings. In this way, the players of the device can rotate the winding wheel 28 such that the winding wheel 28 is located in a particular location where the starting tab 98 appears through the desired aperture 94. For example, referring to FIG. 2, it can be observed that each of the apertures 94 are provided with indicia, as for example from 0, 1, 2 . . . 12. In this way, for the players of the game to use the full time cycle, the players would rotate the winding knob 28 such that the aperture 12 is located over the starting tab 98. If a lesser amount of time is desired, as for example with the players of greater skill, then an aperture for the smaller number associated therewith would be located over the starting tab 98. In this respect, it can be observed that as the winding wheel 28 is rotated, the sleeve 62 and hence, the starting tab 98 provide a fixed indicia with respect to the base 10.

In order for the players to play the game of the present invention, the desired amount of time as established by the winding of the winding knob 28 is obtained. Thus, for example, if the winding knob 28 is wound to its full position as for example, to the number 12 as illustrated thereon, then the full amount of time is provided for the players to recreate the design present on the design card 18. A particular design card 18 is inserted in at least one or more or all of the retaining frame 16. In one form of play, the players can select one match set card such as the design card 18. In order to win the game, a player must correctly match the associated design as presented on the design card by properly orienting the playing pieces in the player tray 36. As indicated, each design card will show the correct position for the playing pieces such that the individual players can select the proper playing pieces and orient them in the proper position. At the start of the game, one of the players will pull the winding knob 28 upwardly which will permit the spring motor 76 to rotate the tower 12 in the manner as previously described. When the first player achieves the recreation of the design with the playing pieces in conformity with the design as shown on the design card, then that player will push the winding knob 28 downwardly which will stop the action of the spring motor 76 and the rotation of the tower 12. In this respect, the tower 12 will stop rotation when the spring energy is consumed if no player achieves the complete design before the time that the tower 12 is rotated to the position where the aperture designated by the number 12 appears over the starting tab 98.

One of the unique aspects of the present invention is that the game can be played in a solitary fashion such that one player can place a design card on the tower 12 and attempt to match the design by recreation thereof with the playing pieces in a pre-selected time. Moreover, the game of the present invention is unique in design in order to allow the players to use several skills in overcoming their opponents. Memory is required in order to remember what the design card presents as it passes into view and rotates out of view. Secondly, speed is required in order to arrange the playing pieces in an expedious manner in order to match the design on the card. In addition, pattern recognition is required in order to match the pattern on the card which in many cases may be more complex than first appears.

The design cards in the present invention can be provided in various patterns. For example, symmetrical patterns may be provided which are easier to recreate due to the fact that the design is easier to remember when the design card is out of view. Secondly, patterns made of isolated elements are easier because the individual cubes do not have to be separated out of the design. Patterns with strong overall diagonal disigns as for example those provided in the preferred embodiment of the present invention can be more difficult which thereby creates a higher degree of skill, and in this case, attracts the interest of adults as well as children.

Thus, there has been illustrated and described a unique and novel playing game which permits one or more players to reconstruct a design from playing pieces in conformity with the design on a rotating member, and which therefore fulfills all of the objects and advantages sought therefor. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention, which is limited only by the following claims.

Having thus described our invention, what we desire to claim and secure by letters patent is:

1. A competitive game for matching designs by players with playing pieces having design portions thereon, said toy game comprising:

(a) a device comprised of (1) a rotatable member, with a plurality of exterior walls thereon, (2) means to provide a design of known geometrical shapes arranged to generate certain geometrical patterns on each of the exterior walls of said rotatable member, and (3) motive means for rotating said member, (b) a plurality of playing pieces capable of being manipulated by each of the players to recreate a design shown on the rotatable member with said playing pieces, said playing pieces having design portions thereon in the form of known geometrical shapes generally corresponding to the geometrical shapes on the exterior walls of said rotatable member, said designs on said playing pieces also capable of being arranged in certain geometrical patterns so that a design shown on the rotatable member can be recreated, the design portion on said playing pieces capable of presenting design patterns in more than one orientation such that the design portions on said playing pieces will create a geometrical pattern in one orientation and a different geometrical pattern in another orientation, and where for said designs shown on the member not all of said orientations of certain of said playing pieces are proper in relationship to a next adjacent playing piece in that the playing pieces must be selected for the proper design portions and properly oriented relative to other playing pieces to recreate a design of the geometric patterns shown on the rotatable member.

2. The toy game of claim 1 further characterized in that means is operatively associated with said motive means to cause said member to rotate for a predetermined time period.

3. A toy game of claim 1 further characterized in that a retaining frame is operatively located on each of said walls for retaining said designs and said designs are formed on substrates which are removably disposed within said retaining frames.

4. A toy game of claim 1 further characterized in that there are a plurality of different designs, whereby different designs may be provided for different players, with such designs thereby being intermittently exposed to the players attempting to recreate them.

5. The toy game of claim 1 further characterized in that some of said design portions are comprised of a plurality of sections of different colors to enable orientation of the playing pieces in accordance with the colored sections.

6. The toy game of claim 5 further characterized in that some of said sections are triangular in shape.

7. The toy game of claim 1 further characterized in that said playing pieces are essentially two dimensional and are triangular in shape.

8. The toy game of claim 1 further characterized in that said playing pieces are essentially two dimensional and are generally rectangular in shape and one of the flat surfaces on at least some of said playing pieces being subdivided into two triangular sections.

9. The toy game of claim 1 further characterized in that said playing pieces are three dimensional and are essentially cubical in shape.

10. The toy game of claim 9 further characterized in that at least one of the flat surfaces of said playing pieces being subdivided into two triangular sections.

11. The toy game of claim 10 further characterized in that one of said sections is of a first color and the other of said sections is of a second color.

12. The competitive game of claim 1 further characterized in that:

(a) an encoded section is associated with each design on the exterior walls and where the encoded section on one of the walls for one player is different than the encoded section on each of the other exterior walls, and (b) said game further comprising a plurality of encoded members with one of said members for each of said players being associated with the use of playing pieces by each of the players, the encoded members of each player being different from one another and the encoded members for each player also conforming to a particular encoded section for each player.

13. A toy game for matching an intermittently exposable design by two or more players with three dimensional playing pieces, said game comprising:

(a) a device having a member with at least a plurality of exterior walls, means to provide a design on said exterior walls of said member, and motive means operatively associated with said member to intermittently expose said designs to a player, (b) a plurality of three dimensional playing pieces for being manipulated by the players to recreate the design shown on said member, said playing pieces having design portions on surfaces thereof which can be combined to recreate the designs shown on said member, at least two of said design portion surfaces of each playing piece lying in planes which are not parallel to one another, the design portions on some of the surfaces being different than the design portions on other of the surfaces and the playing pieces being orientable in more than one position to create different design patterns, whereby the proper surfaces of the playing pieces must be selected and these surfaces oriented in proper directions with respect to adjacent surfaces to recreate the designs shown on the member, an encoded section associated with each design on the exterior walls and where the encoded section on one of the walls for one player is different than the encoded section on any other exterior wall, and (c) a plurality of encoded members with one of said members for each of said players being associated with the use of the playing pieces by each of the players, the encoded members of each player being different from one another and the encoded members for each player also conforming to a particular encoded section for each player.

14. The toy game of claim 13 further characterized in that means is operatively associated with said motive means to cause said intermittent exposure for a predetermined time period.

15. The toy game of claim 13 further characterized in that the member has four exterior walls.

16. The toy game of claim 15 further characterized in that a retaining means is operatively located on each said wall for retaining one of said designs, and said designs and encoded sections are formed on substrates which are removably retained on said exterior walls.

17. The toy game of claim 13 further characterized in that some of said design portions are comprised of a plurality of sections of different colors to enable orientation of the playing pieces in accordance with the colored sections.

18. The toy game of claim 17 further characterized in that some of said sections are triangular in shape.

19. The toy game of claim 13 further characterized in that encoded members are trays which are designed to receive the playing pieces.

20. The toy game of claim 19 further characterized in that the designs on said exterior walls are formed on substrates which are capable of being removably retained on said exterior walls.

21. A method of playing a competitive toy game, said method comprising:

(a) locating a plurality of substrates on a rotatable member with each substrate having at least one design thereon, each of said substrates having an encoded section thereon and where the encoded section for one player is different than the encoded section for any other player, (b) assigning each player a particular design and an associated encoded section, (c) causing said rotatable member to rotate said design into and out of view of at least two competing players located around the rotatable member, (d) providing each player with an encoded member with the encoded member for each player being associated with the use of the playing pieces by each of the players, the encoded member for each player being different from the encoded member for each other player and also conforming to the encoded section assigned to each player, and (e) having the players race with each other in selecting and utilizing three-dimensional playing pieces in order to be the first to recreate his assigned design associated with his assigned encoded section, said playing pieces having design portions on the exterior surfaces thereof, at least two of said surfaces on each playing piece lying in planes which are not parallel to one another, the design portions on some of the surfaces being different than the design portions on other of the surfaces and the playing pieces being orientable in more than one position to create different design patterns, said step of utilizing the playing pieces comprising:

(i) selecting the proper exterior surfaces of selected playing pieces, (ii) and orienting the selected exterior surfaces relative to adjacent surfaces in order to recreate the desired design.

22. The method of claim 21 further including the step of having the first player to recreate his assigned design stop the rotation of the design.

23. The method of claim 21 further including the step of controlling the time of rotation of the design.

24. The method of claim 21 further characterized in that said method comprises providing the same design on the rotatable member for all of the players.

25. The method of claim 21 further characterized in that said method comprises providing a different design on the rotatable member for each player.

26. The method of claim 21 further characterized in that the encoded members are trays which are designed to receive the playing pieces.

27. The method of claim 26 further characterized in that the designs on said exterior walls are formed on substrates which are capable of being removably retained on said exterior walls.

28. A toy game for matching designs by a plurality of players with playing pieces having design portions thereon, said toy game comprising:

(a) a device comprised of (1) a rotatable member, having a plurality of exterior walls arranged circumferentially around said member, (2) means to provide a design on each of said exterior walls of said rotatable member and where the design on one of the exterior walls is for at least one player and is different from the design on another one of the exterior walls which is for at least one other player, such that the design on each of the exterior walls is different from any other design, an encoded section associated with each design on the exterior walls and where the encoded section on one of the exterior walls for one player is different than the encoded section on each of the other exterior walls, (3) motive means for rotating said member, (b) a plurality of playing pieces capable of being manipulated by the players so that each player can attempt to recreate his design as shown on the rotatable member with said playing pieces, said playing pieces having design portions thereon in certain patterns so that the playing pieces must be properly oriented relative to other playing pieces for each player to recreate his design as shown on the rotatable member, and (c) a plurality of encoded members with one of said members for each of said players and being associated with the use of the playing pieces by each of the players, the encoded members of each player being different from one another and the encoded members for each player also conforming to a particular encoded section for each player.

29. The toy game of claim 28 further characterized in that encoded members are trays which are designed to receive the playing pieces.

30. The toy game of claim 29 further characterized in that the designs on said exterior walls are formed on substrates which are capable of being removably retained on said exterior walls.

31. A toy game for matching designs by a plurality of players with playing pieces having design portions thereon, said toy game comprising:

(a) a device comprised of (1) a rotatable member, having a plurality of exterior walls arranged circumferentially around said member, (2) a retaining frame operatively located on each of said walls, (3) a plurality of design depicting substrates with each substrate having a design formed thereon, a color coded section on each substrate with the color coded section on each substrate being different from the color coded section on each other substrate, a different substrate removably disposed within each said retaining frame to provide a design on each of said exterior walls of said rotatable member and where the design on one of the exterior walls is for at least one player and is different from the design on another one of the exterior walls which is for at least one other player, (4) motive means for rotating said member, (b) a plurality of playing pieces capable of being manipulated by the players so that each player can attempt to recreate his design as shown on the rotatable member with said playing pieces, said playing pieces having design portions thereon in certain patterns so that the playing pieces must be properly oriented relative to other playing pieces for each player to recreate his design as shown on the rotatable member, and (c) a plurality of color coded trays for receiving the playing pieces to recreate the design and each tray has a different color coding than the other of the trays, the color coded section associated with each substrate matching each particular color coded tray so that the players can correlate their substrate with their tray.

* * * * *